US011607096B2

(12) United States Patent
Sergyeyenko et al.

(10) Patent No.: US 11,607,096 B2
(45) Date of Patent: Mar. 21, 2023

(54) VACUUM CLEANER

(71) Applicant: Black & Decker, Inc., New Britain, CT (US)

(72) Inventors: Oleksiy Sergyeyenko, Baldwin, MD (US); Ashok Samuel Baskar, Glen Arm, MD (US); Sean Liu, Shenzhen (CN)

(73) Assignee: Black & Decker, Inc., New Britain, CT (US)

( * ) Notice: Subject to any disclaimer, the term of this patent is extended or adjusted under 35 U.S.C. 154(b) by 0 days.

(21) Appl. No.: 17/166,189

(22) Filed: Feb. 3, 2021

(65) Prior Publication Data

US 2022/0240740 A1 Aug. 4, 2022

(51) Int. Cl.

| | |
|---|---|
| ***A47L 9/06*** | (2006.01) |
| ***A47L 5/24*** | (2006.01) |
| ***A47L 9/14*** | (2006.01) |

(52) U.S. Cl.

CPC ..... *A47L 9/0653* (2013.01); *A47L 5/24* (2013.01); *A47L 9/0673* (2013.01); *A47L 9/1409* (2013.01)

(58) Field of Classification Search

CPC ..... A47L 5/24; A47L 5/28; A47L 9/02; A47L 9/064; A47L 9/066; A47L 9/068; A47L 9/0633; A47L 9/0653; A47L 9/0673; A47L 9/1409; A47L 2201/00

USPC ..... 15/321, 322, 344, 345, 415.1, 416, 417, 15/418, 422.2, 373, 422.1

See application file for complete search history.

(56) References Cited

U.S. PATENT DOCUMENTS

| | | | | |
|---|---|---|---|---|
| 4,074,458 | A | 2/1978 | Catlett | |
| 5,337,443 | A | 8/1994 | Steinberg et al. | |
| 5,502,870 | A | 4/1996 | Ragner et al. | |
| 6,125,501 | A | 10/2000 | Yip | |
| 6,536,076 | B2 | 3/2003 | Scian et al. | |
| 6,584,640 | B2 | 7/2003 | Vanderlinden | |
| 6,820,305 | B2 * | 11/2004 | Albert | A47L 9/0633 15/415.1 |
| 6,968,593 | B1 | 11/2005 | Lenkiewicz et al. | |

(Continued)

FOREIGN PATENT DOCUMENTS

| | | | |
|---|---|---|---|
| CN | 111067419 | A | 4/2020 |
| DE | 102004055125 | A1 | 5/2006 |

(Continued)

OTHER PUBLICATIONS

Extended European Search Report, dated Jun. 24, 2022, in corresponding EP Application No. 22153030.6-1016.

*Primary Examiner* — Brian D Keller
*Assistant Examiner* — Sidney D Hohl
(74) *Attorney, Agent, or Firm* — John Yun

(57) ABSTRACT

A vacuum cleaner comprises a housing having a longitudinal axis. A motor-fan assembly is mounted in the housing and arranged to generate an airflow along an airflow path from a dirty air inlet to an air exhaust. A retractable nozzle defines the dirty air inlet and is moveably mounted on the housing. At least a portion of the retractable nozzle is arranged to move between a retracted configuration within the housing and a deployed configuration outside the housing. The portion of the retractable nozzle in the retracted configuration is aligned in a direction along the longitudinal axis and the portion of the retractable nozzle in the deployed configuration is aligned in a direction across the longitudinal axis.

16 Claims, 10 Drawing Sheets

(56) References Cited

U.S. PATENT DOCUMENTS

| | | | | |
|---|---|---|---|---|
| 7,351,269 | B2 | 4/2008 | Yau | |
| 8,069,529 | B2 | 12/2011 | Groff et al. | |
| 8,402,602 | B2 | 3/2013 | Jonsson et al. | |
| 8,444,731 | B2 | 5/2013 | Gomiciaga-Pereda et al. | |
| 8,607,406 | B2 | 12/2013 | Miefalk et al. | |
| 8,745,816 | B2 | 6/2014 | Salvato | |
| 8,875,341 | B2 | 11/2014 | Gooden et al. | |
| 9,044,128 | B1 | 6/2015 | Thomas | |
| 10,064,530 | B2 * | 9/2018 | Krebs | A47L 9/322 |
| 2001/0054212 | A1 | 12/2001 | Walker | |
| 2005/0050675 | A1 * | 3/2005 | Hsu | A47L 9/02 15/344 |
| 2005/0081327 | A1 * | 4/2005 | Lim | A47L 9/02 15/415.1 |
| 2013/0167322 | A1 | 7/2013 | Huang | |
| 2018/0055314 | A1 * | 3/2018 | Rupp | A47L 9/02 |
| 2018/0368649 | A1 | 12/2018 | Kresge | |
| 2019/0090701 | A1 | 3/2019 | Tonderys et al. | |
| 2019/0282056 | A1 | 9/2019 | Conrad et al. | |
| 2019/0328188 | A1 | 10/2019 | Conrad | |
| 2019/0365187 | A1 | 12/2019 | Won et al. | |
| 2020/0154963 | A1 | 5/2020 | Kuhe et al. | |
| 2020/0245837 | A1 * | 8/2020 | Furuta | A47L 9/2826 |
| 2021/0161341 | A1 * | 6/2021 | Imae | A47L 11/4041 |

FOREIGN PATENT DOCUMENTS

| | | | |
|---|---|---|---|
| DE | 102008034458 | A1 | 1/2010 |
| EP | 0263085 | A2 | 4/1988 |
| EP | 1314388 | B1 | 11/2006 |
| EP | 2866632 | B1 | 12/2018 |
| EP | 3530168 | A1 | 8/2019 |
| JP | H11113815 | A | 4/1999 |
| JP | 2004173966 | A | 6/2004 |
| WO | 2020125164 | A1 | 6/2020 |

* cited by examiner

VACUUM CLEANER

TECHNICAL FIELD

The present disclosure relates to a vacuum cleaner. In particular the present disclosure relates to a vacuum cleaner with retractable nozzle.

BACKGROUND

Often domestic cleaning is carried out with handheld vacuum cleaners. In order to improve the functionality of the handheld vacuum cleaner, one or more nozzle accessories are usually provided with the vacuum cleaner to suit different types of cleaning tasks. Since the handheld vacuum cleaner is compact, there is often no room for onboard storage of the accessories. Usually this means that the user is faced with carrying around several nozzle accessories whilst carrying out a cleaning operation which can be cumbersome and inconvenient for the user.

It is known to provide a built-in expandable nozzle in a handheld vacuum cleaner. Such a vacuum cleaner is shown in US2005/0050675 which comprises a built-in expandable nozzle. The nozzle comprises sliders which outwardly stretch and enlarge the size of the nozzle. A problem with this arrangement is that the built-in expandable nozzle takes up a significant proportion of the width of the end of the handheld vacuum cleaner. This means that when the built-in expandable nozzle is retracted, the width the nozzle inlet is limited in size. This limits the functionality of the handheld vacuum cleaner when the built-in nozzle is in the retracted state.

SUMMARY

Examples of the present disclosure aim to address the aforementioned problems.

According to an aspect of the present disclosure there is a vacuum cleaner comprising: a housing having a longitudinal axis; a motor-fan assembly mounted in the housing arranged to generate an airflow along an airflow path from a dirty air inlet to an air exhaust; and a retractable nozzle defining the dirty air inlet and moveably mounted on the housing and at least a portion of the retractable nozzle is arranged to move between a retracted configuration within the housing and a deployed configuration outside the housing; wherein the portion of the retractable nozzle in the retracted configuration is aligned in a direction along the longitudinal axis and the portion of the retractable nozzle in the deployed configuration is aligned in a direction across the longitudinal axis.

Optionally, the housing comprises a dirt container and the portion of the retractable nozzle is arranged to be positioned within the dirt container when the retractable nozzle is in the retracted configuration.

Optionally, the retractable nozzle is arranged to slide with respect to the housing when moving in the direction along the longitudinal axis.

Optionally, the portion of the retractable nozzle is arranged to pivot in the direction across the longitudinal axis.

Optionally, the portion of the retractable nozzle is at least one pivotable arm.

Optionally, the retractable nozzle comprises a slidable nozzle carriage and the at least one arm is pivotally mounted on the slidable nozzle carriage.

Optionally, the retractable nozzle comprises a first arm and a second arm pivotally mounted on the slidable nozzle carriage.

Optionally, the housing comprises at least one guide track arranged to receive a portion of the retractable nozzle such that the at least one guide track limits the movement of the retractable nozzle with respect to the housing.

Optionally, the retractable nozzle comprises a pivot and the pivot is arranged to slide within the at least one guide track.

Optionally, the cross-sectional area of the dirty air inlet is larger when the retractable nozzle is in the deployed configuration than when the retractable nozzle is in the retracted configuration.

Optionally, one or more accessories are attachable to the retractable nozzle when the retractable nozzle is in the retracted configuration.

Optionally, the retractable nozzle comprises at least one catch for selectively securing the retractable nozzle in the deployed configuration or the retracted configuration.

Optionally, the retractable nozzle is configured to move along the airflow path when the retractable nozzle moves within the housing.

Optionally, the dirt container is translucent.

Optionally, the dirt container and retractable nozzle are detachable from the housing.

Optionally, the portion of the retractable nozzle defines an open channel in the direction across the longitudinal axis when the retractable nozzle is in the deployed configuration.

Optionally, the retractable nozzle comprises a projecting lip grippable by the user such that the user can move the retractable nozzle from the retracted configuration to the deployed configuration.

Optionally, the vacuum cleaner is a handheld vacuum cleaner.

BRIEF DESCRIPTION OF THE DRAWINGS

Various other aspects and further examples are also described in the following detailed description and in the attached claims with reference to the accompanying drawings, in which:

DETAILED DESCRIPTION

Figure 1:
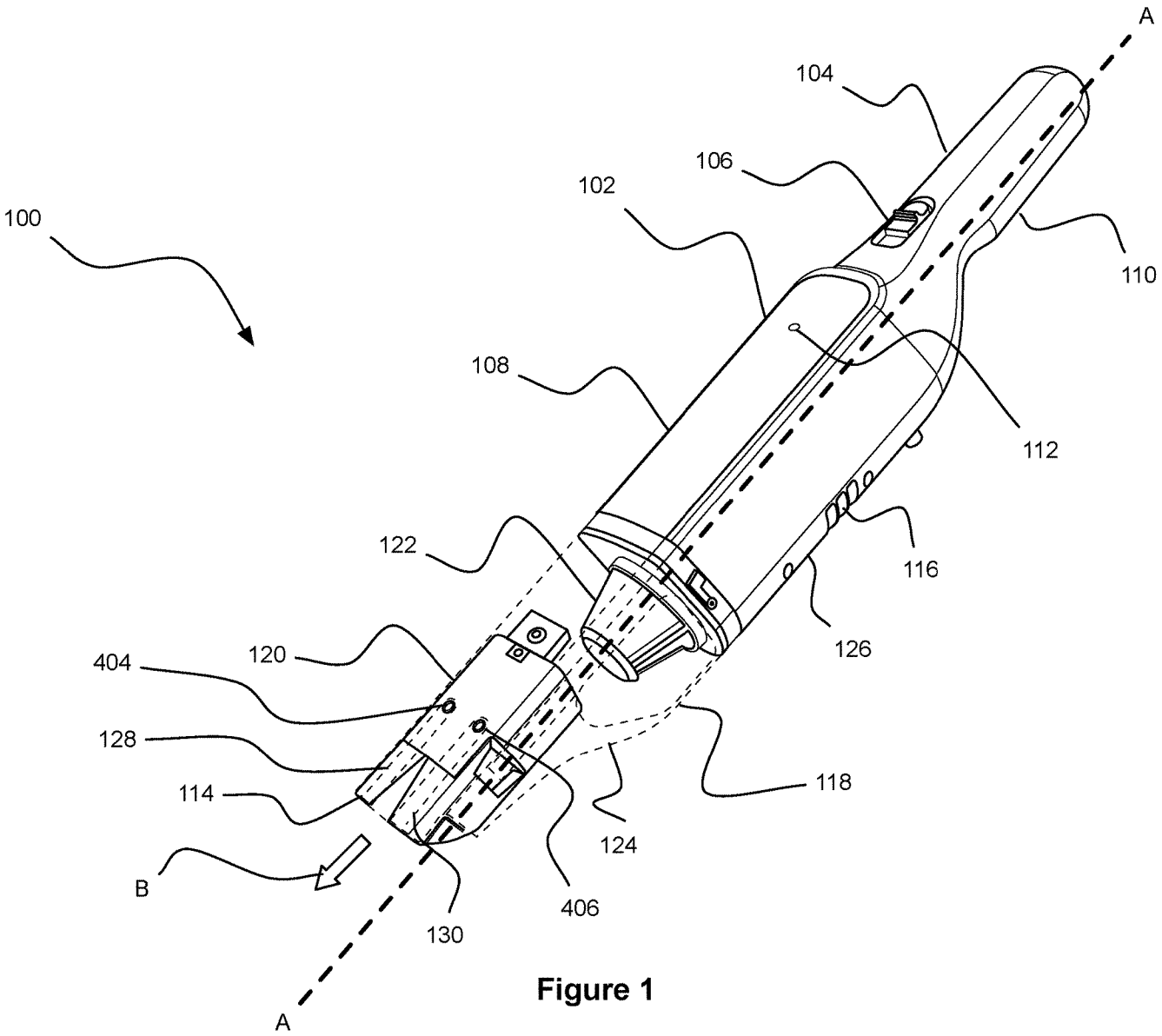
FIG. 1 shows a perspective view of a vacuum cleaner according to an example.

FIG. 1 shows a perspective view of a vacuum cleaner 100. The vacuum cleaner 100 as shown in FIG. 1 is a handheld vacuum cleaner (also known as a "handvac"), but in other examples the vacuum cleaner 100 may be an upright vacuum cleaner, a stickvac, a canister vacuum cleaner or any other type of vacuum cleaner. References to the vacuum cleaner 100 hereinafter will be in reference to the handheld vacuum cleaner as shown in the Figures.

The vacuum cleaner 100 comprises a housing 102. The housing 102 comprises a clam shell type construction which comprises two halves which are fastened together. The halves of the housing 102 are fastened together with screws but in alternative examples any suitable means for fastening the housing together may be used such as glue, clips, bolts and so on. For the purposes of clarity, the fastenings in the housing 102 are not shown.

The housing 102 comprises a handle 104. The handle 104 is integral with the housing 102 and the user grips the handle 104 when operating the vacuum cleaner 100.

Although not shown in the Figures, in some examples, the handle 104 is moveably mounted to the housing 102. In this way, the housing 102 comprises a pivot whereby the handle 104 is pivotally mounted to the housing 102. This means that the angle of the handle 104 with respect to the handheld vacuum cleaner 100 can be adjusted. This can make reaching awkward spaces such as under chairs or on top of cupboards easier. Additionally or alternatively, the handle 104 is slidable with respect to the housing 102. Accordingly, the handle 104 is extendable and means that the flexibility of the vacuum cleaner 100 is increased. In some examples, the handle 104 is telescopic and is stowed within the housing 102 when not extended. Alternatively a handle accessory (not shown) is attachable to the handle 104 in order to extend the handle 104. In this way, the handle accessory is configured to convert the vacuum cleaner 100 into a stickvac.

In some examples, the handle 104 comprises an ON/OFF switch 106 for operating the vacuum cleaner 100. The ON/OFF switch 106 as shown in FIG. 1 is a slide switch 106 mounted on a top side 108 of the housing 102. However in some alternative examples, the ON/OFF switch 106 may be a trigger switch mechanically coupled to a microswitch (not shown). The trigger switch 106 may be positioned on the underside 110 of the housing 102. In other examples, the switch 106 can be located on any exterior surface of the vacuum cleaner 100.

Figure 2:
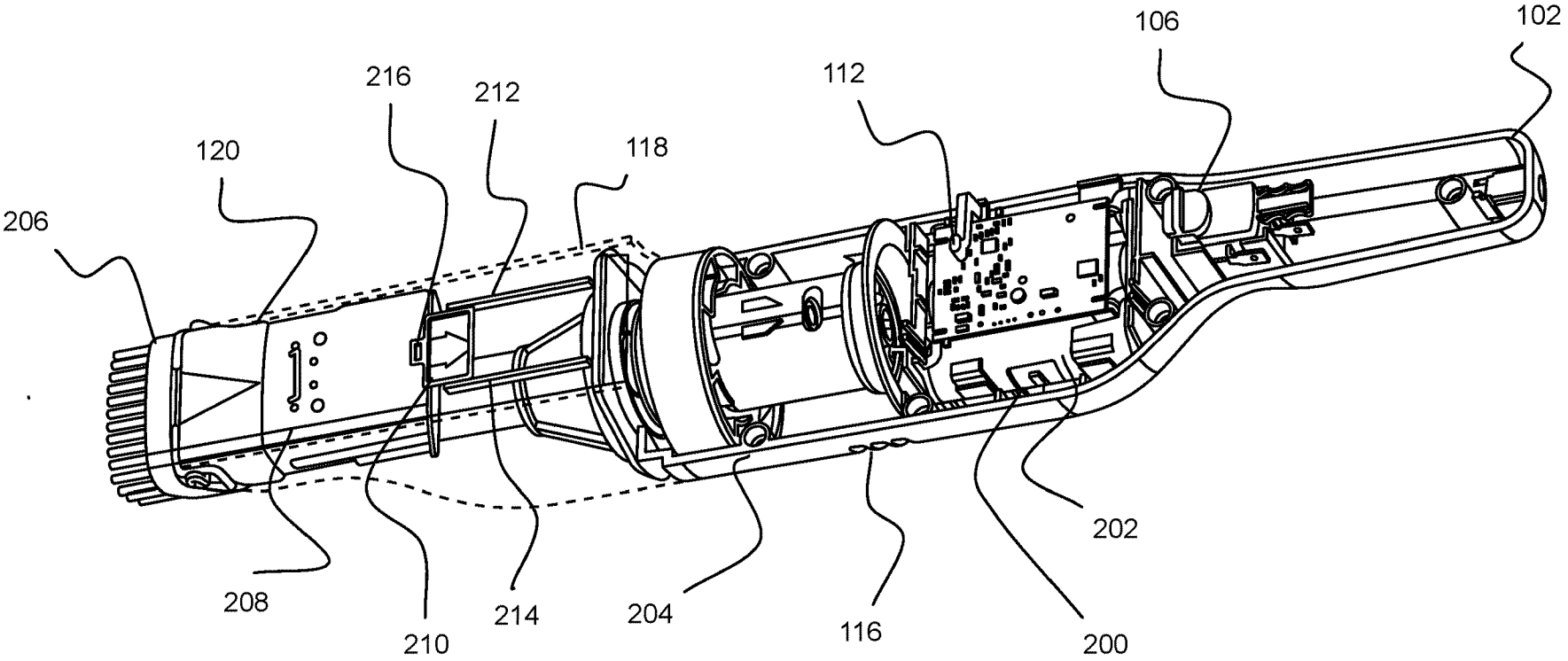
FIG. 2 shows a cut-away perspective view of a vacuum cleaner according to an example.

In some examples, the handle 104 comprises one or more indicators for providing information about the vacuum cleaner 100 to the user. A battery indicator 112 is mounted on the housing 102 for indicating to the user the charge level status of a battery 200 (as best shown in FIG. 2). In some examples, the battery 200 is housed in a battery housing 202. FIG. 2 shows a cut-away perspective view of the vacuum cleaner 100. The battery housing 202 may be mounted to the housing 102. In some examples, the battery housing 202 is integral with the housing 102. In other examples, the battery housing 202 and the battery 200 are releasably mountable to the housing 102. In this way, the battery 200 can be switched with another battery.

Further indicators (not shown) such as filter status indicators (filter blocked/filter cleared) can be mounted on the handle 104 or elsewhere on the housing 102. In other examples, the indicator is a symbol indicating to the user when to charge the vacuum cleaner 100.

Turning back to FIG. 1, the handheld vacuum cleaner 100 comprises a generally elongate shape which extends along the longitudinal axis A-A. The housing 102 comprises a dirty air inlet 114 and a clean air outlet 116. An air flow path extends between the dirty air inlet 114 and the clean air outlet 116. The air flow path will be discussed in further detail below. The dirty air inlet 114 extends substantially along the longitudinal axis A-A as shown in FIG. 1.

The clean air outlet 116 can comprise a plurality of openings 116 which are mounted in a motor housing 204 (as best shown in FIG. 2). The motor housing 204 is mounted to the housing 102. In some examples and as shown in FIG. 1 and FIG. 2, the motor housing 204 is integral with the housing 102.

The plurality of openings 116 can be directed in a plurality of directions for dissipating the clean air exhaust into the environment. For example, the plurality of openings 116 can be orientated to direct the clean air away from the surface to be cleaned. This means that the dirt and debris on the surface to be cleaned is not dislodged by the exhaust clean air and blown away from the dirty air inlet 114. In some alternative examples (not shown), the clean air outlet 116 directs clean exhaust air in a direction which is substantially perpendicular to the longitudinal axis A-A. For example, the clean air outlet 116 directs the exhaust clean air out of a back surface 126 of the housing 102 of the vacuum cleaner 100.

Figure 3:
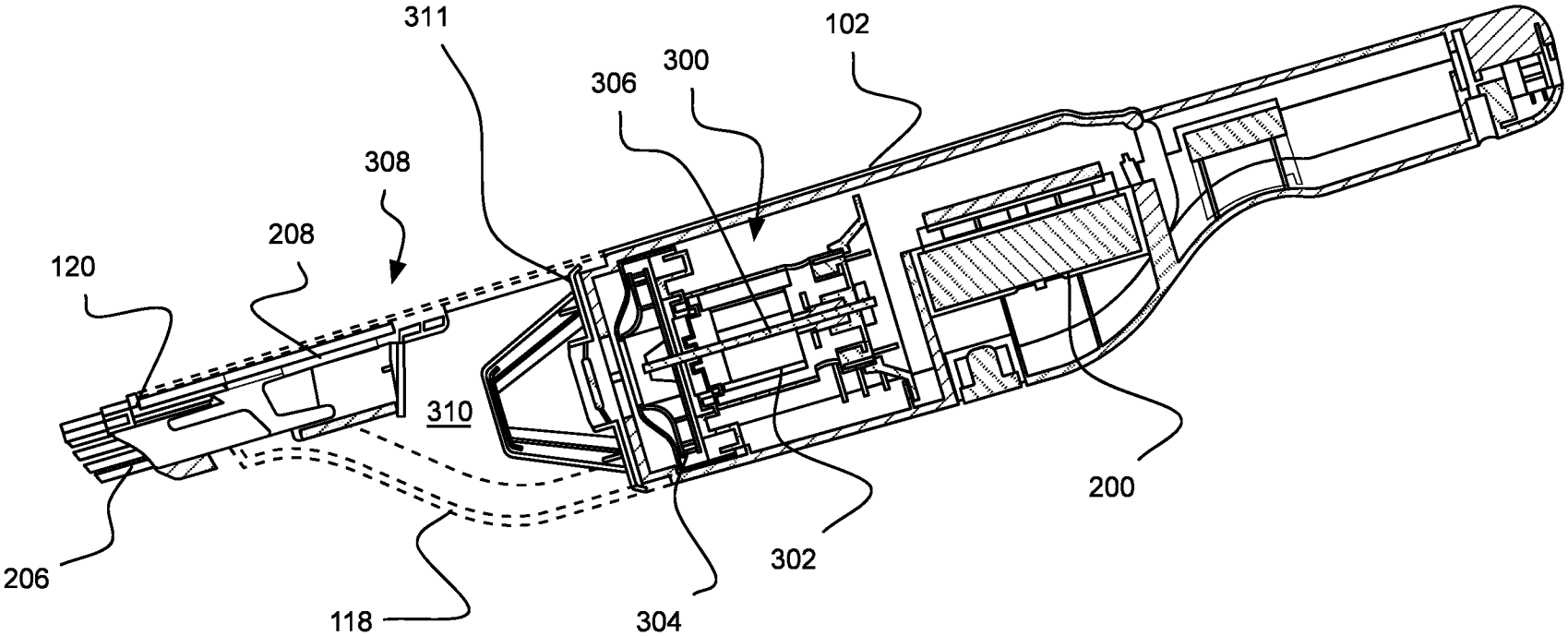
FIG. 3 shows a cross-sectional side view of a vacuum cleaner according to an example.

The vacuum cleaner 100 comprises a motor-fan assembly 300 which is best shown in FIG. 3. FIG. 3 shows a cross-sectional side view of the vacuum cleaner 100. The motor-fan assembly 300 comprises a motor 302 and a fan 304 for generating a negative pressure for sucking up dirt and debris via the dirty air inlet 114. In this way, the motor-fan assembly 300 causes the airflow from the dirty air inlet 114 to the clean air outlet 116.

The dirty air inlet 114 can optionally comprise a coupling engageable with a floor extension tube (not shown) or one or more other accessories such as a brush, a crevice tool or any other accessory. This means that the handheld vacuum cleaner 100 can e.g. allow the user to extend the reach of the handheld vacuum cleaner 100 when the dirty air inlet 114 is connected to a floor extension tube and associated accessories. An example of such an accessory is shown in FIGS. 2 and 3 whereby a removeable brush accessory 206 is mounted to the dirty air inlet 114.

The motor-fan assembly 300 is housed within the motor housing 204 and electrically connected to a power source. As mentioned above, the power source is a battery 200 comprising a plurality of battery cells. In some examples, the battery 200 is a lithium ion battery. In other examples, the battery 200 can be any suitable type of battery for use in a vacuum cleaner 100. In other examples the vacuum cleaner 100 additionally or alternatively comprises a mains electricity supply (not shown).

The rotation axis of the motor-fan assembly 300 is substantially parallel to the longitudinal axis A-A of the housing 102. In some examples, the rotation axis of the motor-fan assembly 300 is coaxial with the longitudinal axis A-A of the housing 102. However, in other examples, the rotation axis of the motor-fan assembly 300 can be offset from the longitudinal axis of the housing 102.

Turning back to FIG. 1, the vacuum cleaner 100 will be described in further detail. As shown in FIG. 1, a dirt container 118 is optionally removeably mounted on the housing 102. The dirt container 118 is arranged to receive dirt or debris which is separated from the dirty air flow received via the dirty air inlet 114 during operation. In some examples, the dirt container 118 is optionally transparent or translucent. This means that the user can visually identify when the dirt container 118 is full and empty the dirt container 118 accordingly. In some other examples the dirt container 118 is opaque and not see-through.

The dirt container 118 as shown in FIG. 1 comprises an external wall 124 which forms part of the external surface of the vacuum cleaner 100. The dirt container 118 as shown in FIG. 1 is a separate removeable part from the housing 102. The dirt container 118 comprises a portion which is releasably mountable to the housing 102. In some examples, the entire dirt container 118 is releasably mountable to the housing 102. Alternatively, the dirt container 118 is integral with the housing 102. For example, the dirt container 118 optionally comprises a releasable door or lid (not shown) for emptying the dirt container 118 In this example, dirt container 118 may be hinged to the housing 102.

A filter 122 is mounted to the housing 102 within the dirt container 118. In this way, dirt and debris entrained in the airflow is removed from the swirling airflow within the dirt container 118. The filter 122 prevents dirt and debris from entering the motor housing 204 and contaminating the motor-fan assembly 300.

The dirt container 118 is represented in FIG. 1 with dashed lines for the purposes of clarity and showing the inside of the dirt container 118. As shown in FIG. 1 the vacuum cleaner 100 comprises a retractable nozzle 120 moveably mounted on the housing 102. The retractable nozzle 120 is arranged to move between a retracted configuration within the housing 102 and a deployed configuration outside the housing 102. The retractable nozzle 120 as shown in FIG. 1 is in the retracted configuration.

This means that the vacuum cleaner 100 can be compact, but still has space for onboard storage of a nozzle accessory. This means that the user does not need to carry out a nozzle accessory whilst carrying out a cleaning operation which convenient for the user.

When the retractable nozzle 120 is in the retracted configuration in some examples, the retractable nozzle 120 is completely retracted within the housing 102. Alternatively, in other examples, the retractable nozzle 120 is partially retracted within the housing 102 in the retracted configuration.

In some examples as shown in the Figures, the retractable nozzle 120 is retractable into the dirt container 118. In this way, the retractable nozzle 120 nests within the space 310 within the dirt container 118. The retractable nozzle 120 creates a baffle within the dirt container 118 when in the retracted configuration. This means that the retractable nozzle 120 can increase the swirling of the air within the dirt container 118 and help remove dirt and debris entrained in the airflow.

Figure 10:
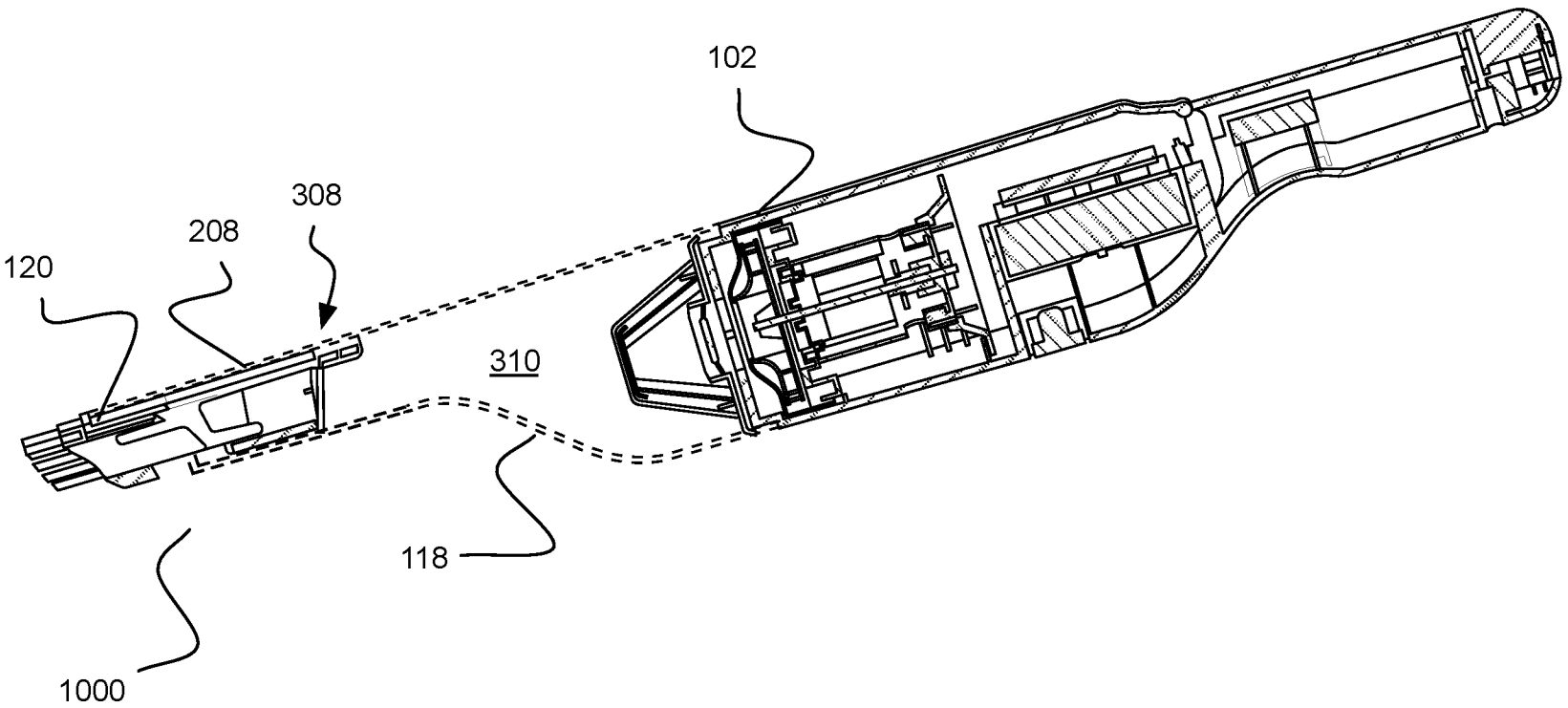
FIG. 10 shows a cross-sectional side view of the vacuum cleaner 100 according to another example.

In some other examples, the retractable nozzle 120 does not extend into the dirt container 118 in the retracted configuration. Instead the retractable nozzle 120 is positioned within an extended nozzle housing portion 1000 as shown in FIG. 10. FIG. 10 shows a cross-sectional side view of the vacuum cleaner 100 according to another example. The example as shown in FIG. 10 is the same as shown in FIG. 3 except that the retractable nozzle 120 does not extend in to the dirt container 118 when in the retracted configuration. In this way, the retractable nozzle 120 is not position in the space 310 within the dirt container 118. This means that the capacity of the dirt container 118 is not reduced by retracting the retractable nozzle 120 into the housing 102.

In some other examples, the retractable nozzle 120 can retract into any other part of the housing 102. This may be less preferable because if the retractable nozzle 120 retracts into other parts other vacuum cleaner 100, then the airflow path may have to be diverted accordingly.

Turning back to FIG. 1, the retractable nozzle 120 is moveably mounted on the housing 102 and at least a portion of the retractable nozzle 120 is arranged to move between a retracted configuration within the housing 102 and a deployed configuration outside the housing 102. As shown in FIG. 1, the airflow path at the dirty air inlet 114 is parallel with the longitudinal axis A-A of the vacuum cleaner 100. This means that the retractable nozzle 120 in some examples is configured to move in a direction parallel with the longitudinal axis A-A of the vacuum cleaner 100. The direction of movement is show in FIG. 1 by arrow labelled B.

By storing the retractable nozzle 120 along the longitudinal axis A-A of the vacuum cleaner 100 and then unfolding one or more parts of the retractable nozzle 120 in a lateral direction once the retractable nozzle 120 is outside the housing 102, the retractable nozzle 120 can be deployed in a configuration with the dirty air inlet 114 having a large cross-sectional area. At the same time the retractable nozzle 120 comprises an arrangement in the retracted configuration wherein the dirty air inlet 114 has a smaller, but still useful cross-sectional area.

Figure 9B:
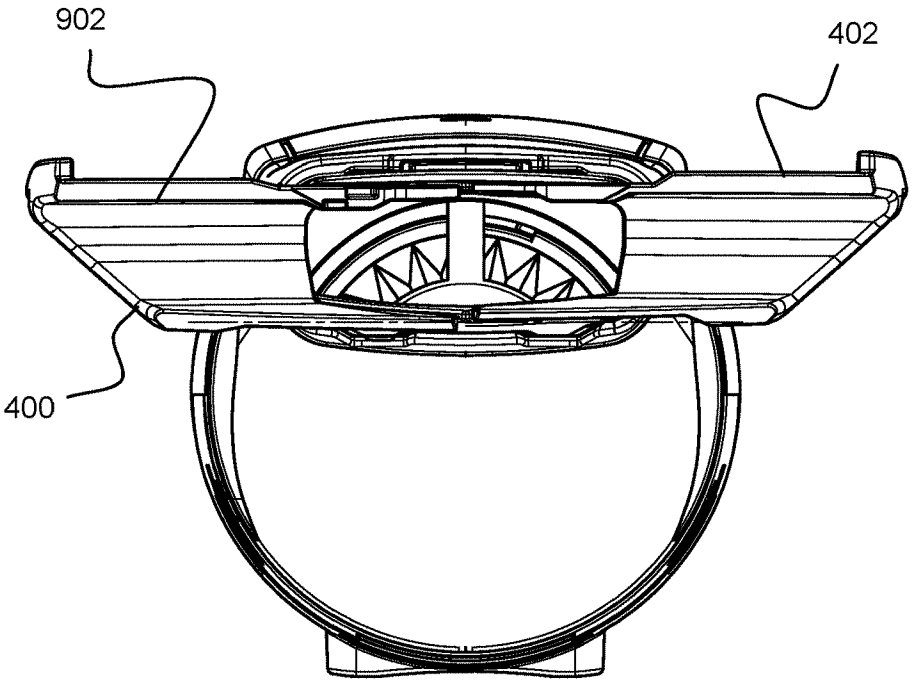
FIGS. 9*a* and 9*b* respectively show a front view of a vacuum cleaner with a retractable nozzle in a retracted configuration and a deployed configuration according to an example.
Figure 9A:
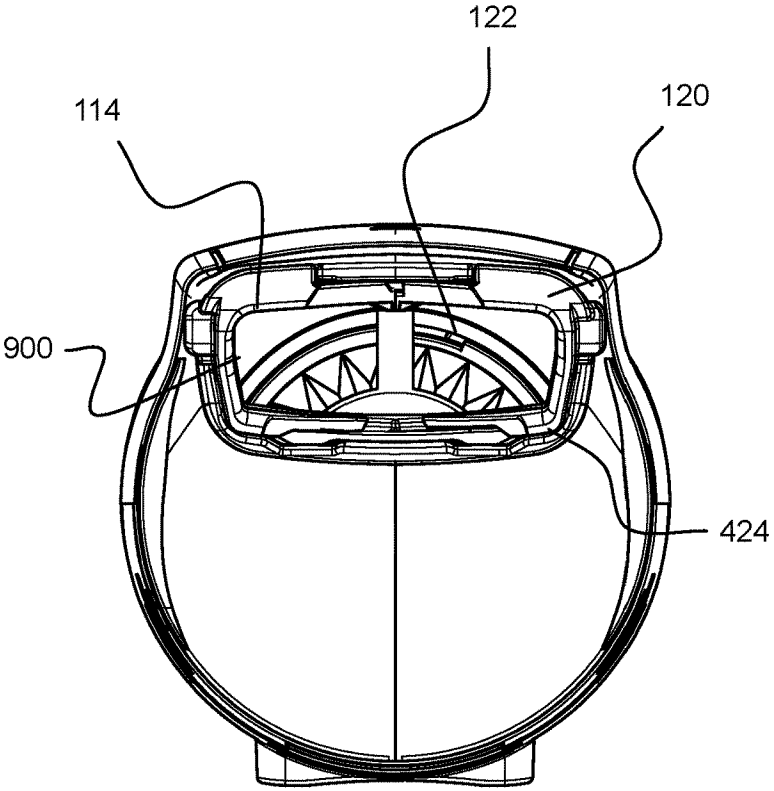

A brief reference will be made to FIGS. 9*a* and 9*b*. FIGS. 9*a* and 9*b* show a front view of the vacuum cleaner 100 with the retractable nozzle 120 respectively in the retracted configuration and the deployed configuration. The retractable nozzle 120 defines the dirty air inlet 114 and the airflow path extends through the retractable nozzle 120. Indeed, it is possible to see the filter 122 within the dirt container 118. In the retracted configuration, the first and second nozzle arms 400, 402 define the nozzle mouth 424 as discussed in reference to FIG. 4 below. In this way, the dirty air inlet 114 has a first retracted cross-sectional area 900 at the nozzle mouth 424. In the deployed configuration, the dirty air inlet 114 is expanded and the first and second nozzle arms 400, 402 have been folded out. The dirty air inlet 114 has a larger second deployed cross-sectional area 902. The second cross-sectional area 902 comprises the first cross-sectional area of the nozzle mouth 424 and the area of the first and second nozzle arms 400, 402.

In the deployed configuration, the second deployed cross-sectional area 902 of the dirty air inlet 114 narrows as the airflow path enters the dirt container 118. In some examples, the smallest cross-sectional area of the dirty air inlet 114 in the deployed configuration, is the same as the first retracted cross-sectional area 900 in the retracted configuration.

As mentioned above, in the retracted configuration the first retracted cross-sectional area 900 at the nozzle mouth 424 is smaller and the air speed will be higher. This means that there will be better dirt pick up rate through the smaller area of the nozzle mouth 424. In contrast in the deployed configuration, the second deployed cross-sectional area 902 at the nozzle mouth 424 is approximately is three times wider. In the deployed configuration, there is a slower air speed and lower dirt pick up rate through the larger second deployed cross-sectional area 902. In both the retracted configuration and the deployed configuration, the airflow of the vacuum cleaner 100 should be approximately the same. This means that in the retracted configuration the vacuum cleaner 100 will be better for imbedded debris (e.g. in a rug or carpet) and in the deployed configuration the vacuum cleaner 100 will pick up more loose debris (e.g. circular cereal hoops).

The retractable nozzle 120 will now be discussed in further detail with respect to FIG. 2. In FIG. 2 the retractable nozzle 120 is in the retracted configuration. As mentioned previously, in FIG. 2 the removeable brush accessory 206 is mounted on the retractable nozzle 120. In some examples, the removeable brush accessory 206 is selectively mountable to the retractable nozzle 120 in the retracted configuration. In other examples, other accessories such as a crevice tool (not shown), or a rotating brush accessory (not shown) can be mounted to the retractable nozzle 120. This means that the user can mount different accessories to the retractable nozzle 120 when the retractable nozzle 120 is in the retracted configuration. This can increase the functionality of the vacuum cleaner 100.

The retractable nozzle 120 comprises a nozzle carriage 208 which slidably engages with the housing 102. The nozzle carriage 208 is a hollow element on to which one or more moveable nozzle parts are mounted. The movement of the one or more moveable nozzle parts will be discussed in further detail below. Since the nozzle carriage 208 is hollow, the airflow path is directed through the nozzle carriage 208 when the retractable nozzle 120 is any configuration e.g. in the retracted configuration and in the deployed configuration.

The nozzle carriage 208 is configured to slide between a retracted configuration and a deployed configuration. In the retracted configuration, the nozzle carriage 208 is in a first position and in the deployed position, the nozzle carriage 208 is in a second position. The second position is closer to the dirty air inlet 114 than the first position.

The nozzle carriage 208 optionally comprises one or more guide mechanisms for ensuring that the nozzle carriage 208 is seated correctly when moving between the retracted and deployed configurations.

Figure 4:
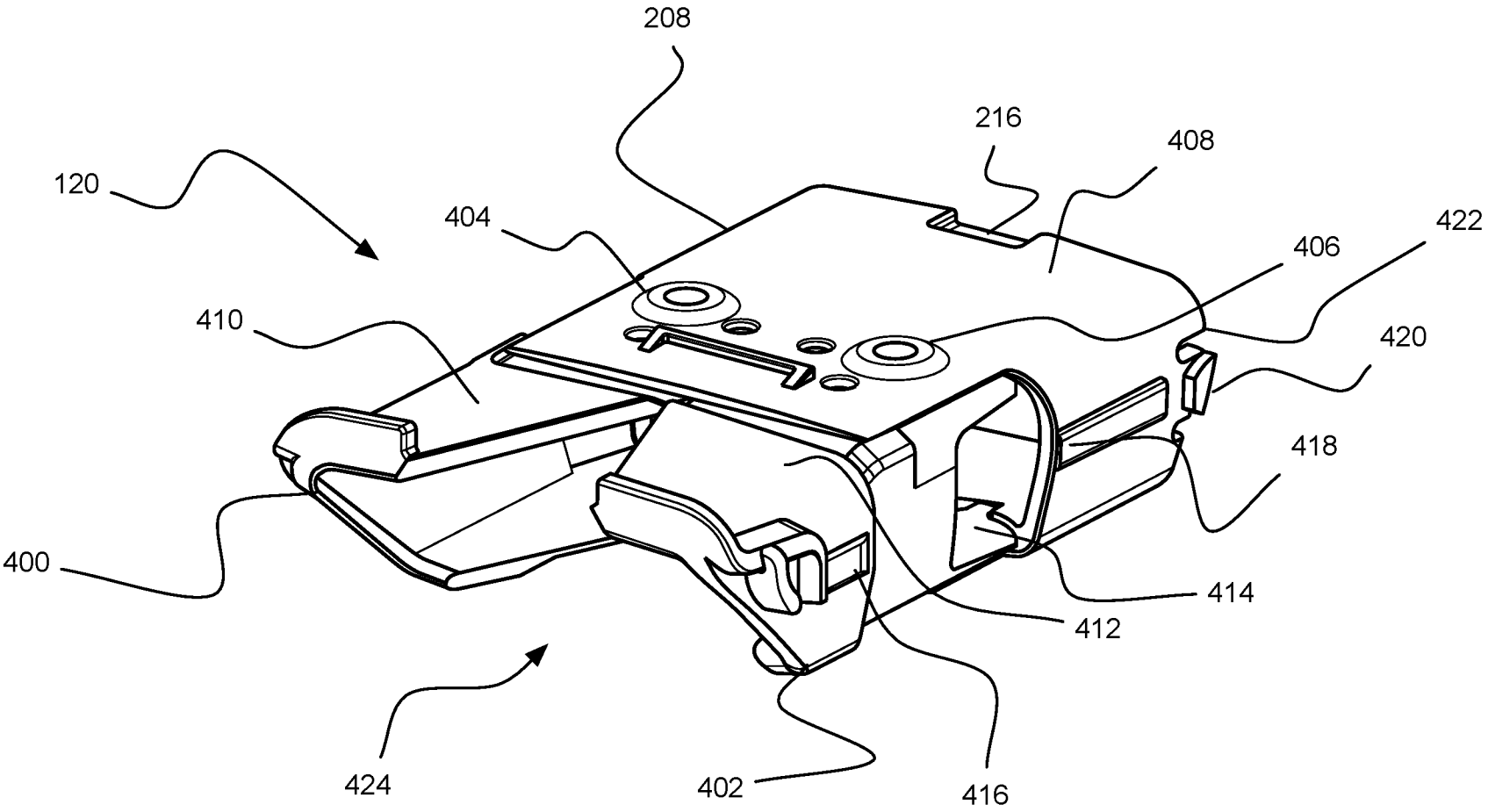
FIG. 4 shows a perspective view of a retractable nozzle in a retracted configuration according to an example.

Optionally the nozzle carriage 208 comprises a stop tab 420 projecting from the side 422 of the nozzle carriage 208 as shown in FIG. 4. The stop tab 420 prevents the user from completely removing the retractable nozzle 120 from the housing 102. Although only one side 422 is shown in FIG. 4, both sides of the nozzle carriage 208 may comprise a stop tab 420.

In some examples, the nozzle carriage 208 optionally comprises a guide tongue portion 210 which is positioned between a pair of guide rails 212, 214 mounted on the housing 102. As shown in FIG. 2 the guide rails 212, 214 are mounted on the inside of the dust container 118. In this way, the guide tongue portion 210 is positioned between the pair of guide rails 212, 214 in the retracted configuration. This means that the guide rails 212, 214 help seat the nozzle carriage 208 correctly in the retracted configuration.

In some examples, the nozzle carriage 208 comprises a recess 216 for receiving a holding protrusion (not shown) mounted on the inside of the housing 102. When the nozzle carriage 208 is in the retracted configuration, the holding protrusion engages with the recess 216 and the retractable nozzle 120 is held in the retracted configuration. In order to release the retractable nozzle 120, the user pulls the retractable nozzle 120 such that the holding protrusion flexes and releases from the recess 216. In some other examples, there is no recess 216 or holding protrusion. Alternatively in some examples, there is a friction fit between the retractable nozzle 120 and the dirt container 118 holding the retractable nozzle 120 in place with respect to the dirt container 118 when in the retracted configuration or in the deployed configuration.

Turning to FIG. 3, the retractable nozzle 120 will be discussed in more detail. The retractable nozzle 120 is again shown in the retracted configuration in FIG. 3. Here the retractable nozzle 120 extends into the dirt container 118. An internal end 308 of the nozzle carriage 208 is positioned adjacent to the filter 122. In this way, the retractable nozzle 120 does not collide with the filter 122 when retracted into the dirt container 118. The retractable nozzle 120 can extend any distance into the dirt container 118. For example, although not shown in FIG. 3, the internal end 308 can abut the end surface 311 of the dirt container 118. This means that the retractable nozzle 120 can be longer. However, this may be a less preferred example because the volume of the dirt container 118 is reduced.

Figure 5:
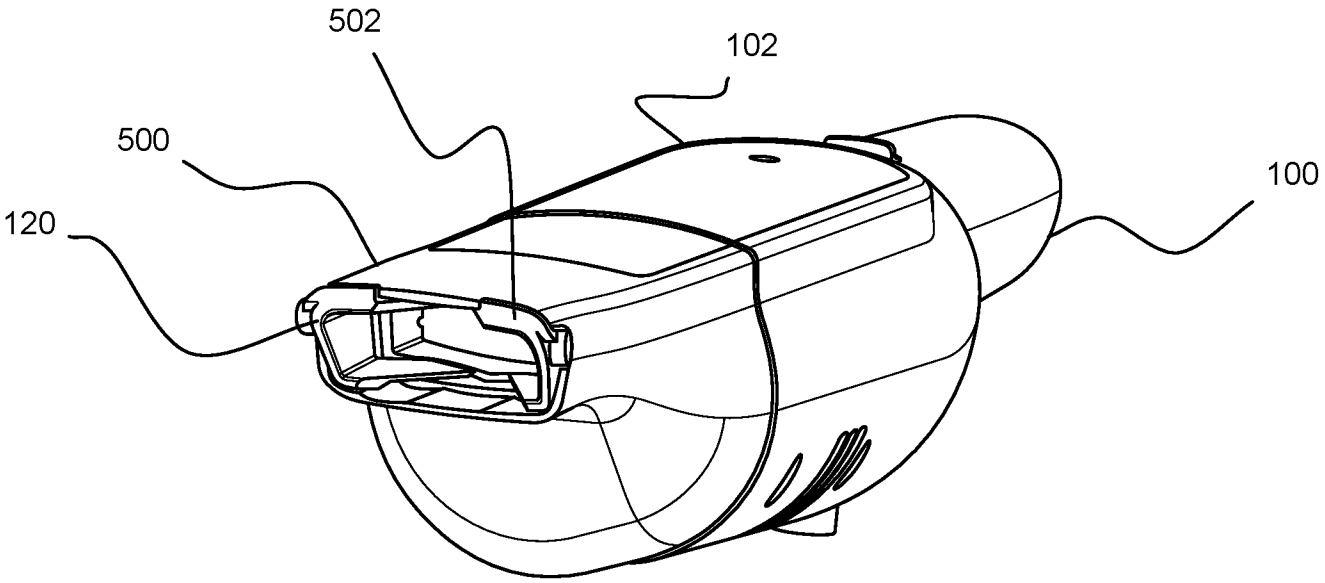
FIG. 5 shows a perspective view of a vacuum cleaner with a retractable nozzle in a retracted configuration according to an example.

The retractable nozzle 120 will now be discussed in more detail with respect to FIGS. 4 and 5. FIG. 4 shows a perspective view of the retractable nozzle 120 in a retracted configuration. FIG. 5 shows a perspective view of the vacuum cleaner 100 with the retractable nozzle 120 in a retracted configuration.

As shown in FIG. 5, the retractable nozzle 120 is positioned within the housing 102. The housing 102 as shown in FIG. 5 is moulded to form integral nozzle portion 500 of the housing 102. The integral nozzle portion 500 is optionally moulded as part of the dirt container 118.

The retractable nozzle 120 is fully retracted into the housing 102. The retractable nozzle 120 optionally comprises lip 502 configured to engage the integral nozzle portion 500 of the housing 102 in the retracted configuration. The lip 502 projects upwardly and provides a surface for the user to grip to pull the retractable nozzle 120 from the retracted configuration into the deployed configuration.

The retractable nozzle 120 will be discussed in more detail with respect to FIG. 4. A first nozzle arm 400 and a second nozzle arm 402 are pivotally mounted on the nozzle carriage 208. The first nozzle arm 400 is pivotally mounted on the nozzle carriage 208 at a first pivot 404. Similarly the second nozzle arm 402 is pivotally mounted on the nozzle carriage 208 at a second pivot 406. The first nozzle arm 400 and the second nozzle arm 402 are folded forwards so that the first nozzle arm 400 and the second nozzle arm 402 extend in a direction parallel with the longitudinal axis A-A of the vacuum cleaner 100.

The first and second nozzle arms 400, 402 of the retractable nozzle 120 are configured to move between a retracted configuration and a deployed configuration. The first and second nozzle arms 400, 402 are shown in the deployed configuration in FIGS. 6 and 7. The deployed configuration of the first and second nozzle arms 400, 402 will be discussed in further detail below.

Turning back to FIG. 4, the first and second nozzle arms 400, 402 in the retracted configuration will be discussed in more detail. In some examples, the first and second pivots 404, 406 comprise a recess (not shown) for each receiving a pivoting protrusion (not shown) projecting from the surface of the first nozzle arm 400 and the second nozzle arm 402. The first and second pivots 404, 406 comprise raised projections projecting upwardly from an upper surface 408 of the nozzle carriage 208. In some examples the pivoting protrusion on the first and second nozzle arms 400, 402 is a circular button (not shown) moulded in each upper surface 410, 412 of the first nozzle arm 400 and the second nozzle arm 402. The circular button is received in the reciprocal circular recess in the nozzle carriage 208. Similarly, further pivots (not shown) are provided in line with the first and second pivots 404, 406 on the underside surface 414 of the nozzle carriage 208 and the first nozzle arm 400 and the second nozzle arm 402.

When the first and second nozzle arms 400, 402 in the retracted configuration, the first and second nozzle arms 400, 402 define a nozzle mouth 424. The nozzle mouth 424 is substantially the same size as the integral nozzle portion 500 of the dirt container 118. This means that there is negligible difference to the airflow at the dirty air inlet 114 when the retractable nozzle 120 is mounted to the housing 102 when compared to the housing without the retractable nozzle 120. In other words, the configuration of the first and second nozzle arms 400, 402 in the retracted configuration does not affect the airflow and the operability of the vacuum cleaner 100. For example, the retractable nozzle 120 comprises a cross-sectional area which is sufficiently large to suck up large objects like circular cereal hoops, small stones and other large debris one might find on the domestic floor in all configurations.

In some examples, the first and second pivots 404, 406 are arranged to project respectively into a first guide track 128 and a second guide track 130. FIG. 1 shows the first and second pivots 404, 406 slidably mounted within the first and second guide tracks 128, 130. The first and second guide tracks 128, 130 ensure that the first and second pivots 404, 406 move in a straight line in a parallel direction along the longitudinal axis A-A. This means that the first and second guide tracks 128, 130 keep the first and second pivots 404, 406 and the sides of the nozzle carriage 208 parallel with the sides of the housing 102. Accordingly, the retractable nozzle 120 can smoothly move between the retracted and the deployed configurations.

Figure 6:
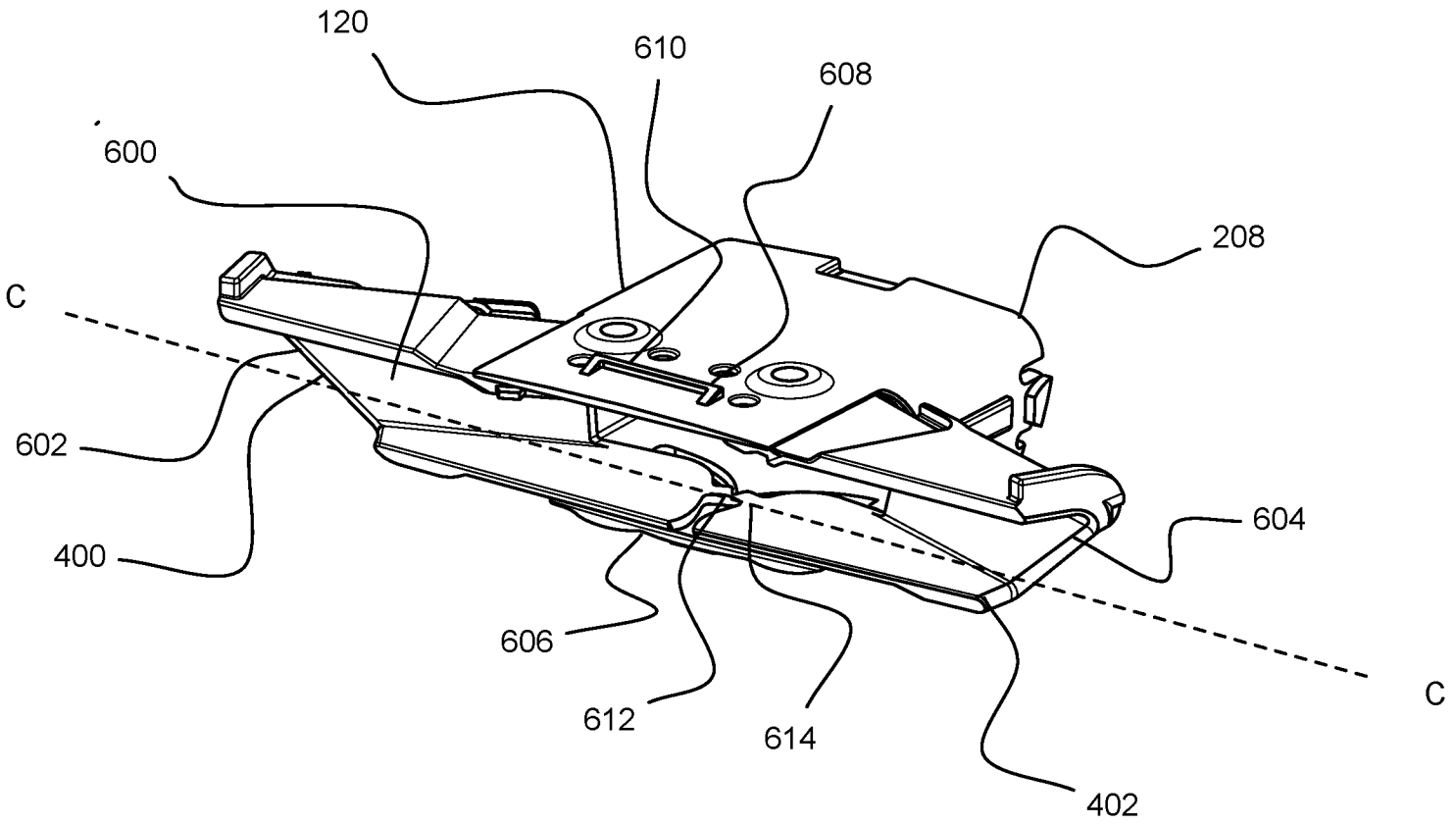
FIG. 6 shows a perspective view of a retractable nozzle in a deployed configuration according to an example.
Figure 7:
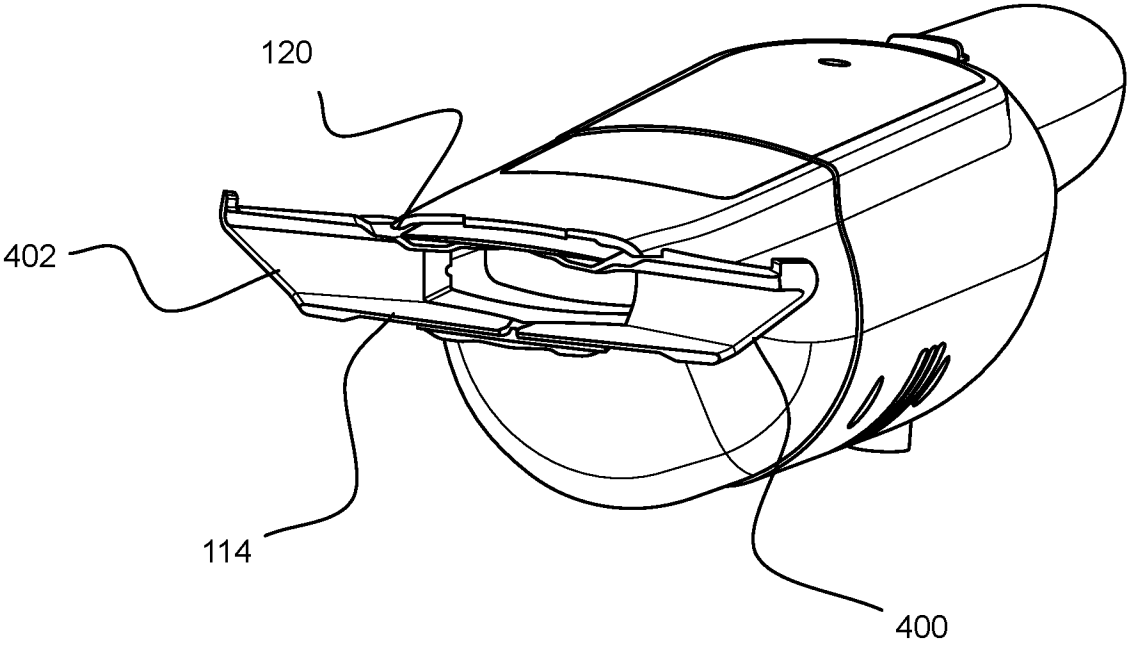
FIG. 7 shows a perspective view of a vacuum cleaner with a retractable nozzle in a deployed configuration according to an example.

The deployed configuration of the first and second nozzle arms 400, 402 will now be discussed in reference to FIGS. 6 and 7. FIG. 6 shows a perspective view of the retractable nozzle 120 in a deployed configuration. FIG. 7 shows a perspective view of the vacuum cleaner 100 with the retractable nozzle 120 in a deployed configuration.

The retractable nozzle 120 as shown in FIGS. 6 and 7 is the same as the retractable nozzle 120 shown in FIGS. 4 and 5. However, the first and second nozzle arms 400, 402 have pivoted into the deployed configuration.

As the first and second nozzle arms 400, 402 pivot with respect to the nozzle carriage 208, the first and second nozzle arms 400, 402 rotate from being aligned in a direction parallel with the longitudinal axis A-A to a direction perpendicular to the longitudinal axis A-A.

Figure 8C:
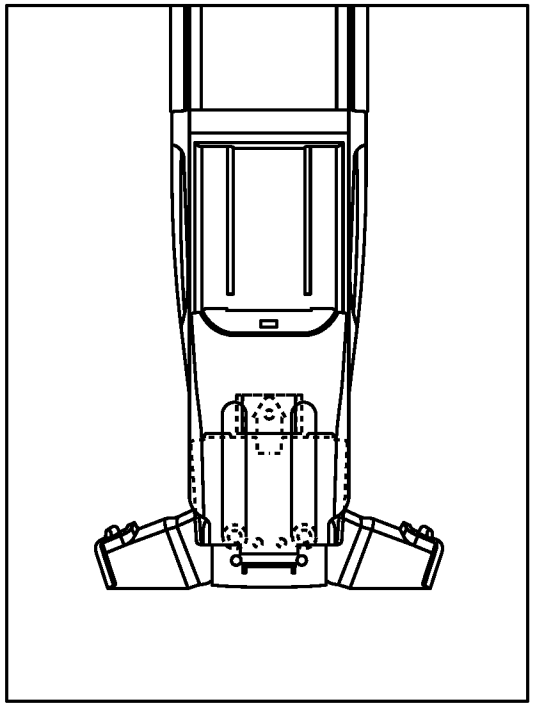
FIGS. 8*a*, 8*b* and 8*c* respectively show a partial plan view of a vacuum cleaner and retractable nozzle in different positions according to an example.
Figure 8B:
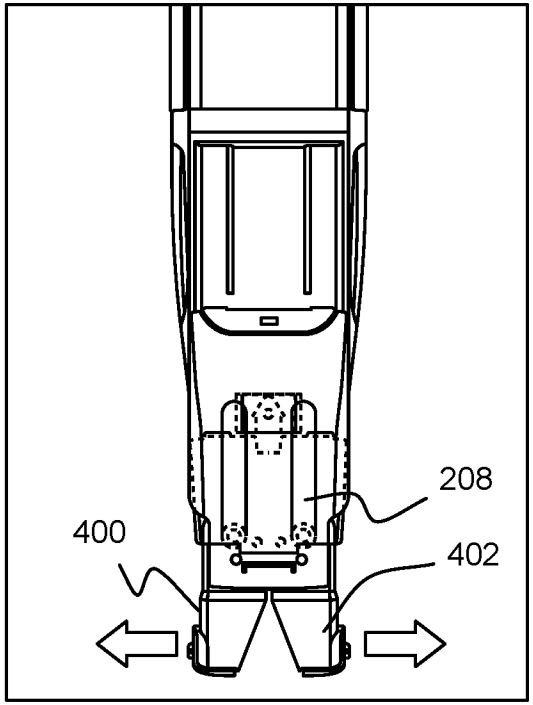
Figure 8A:
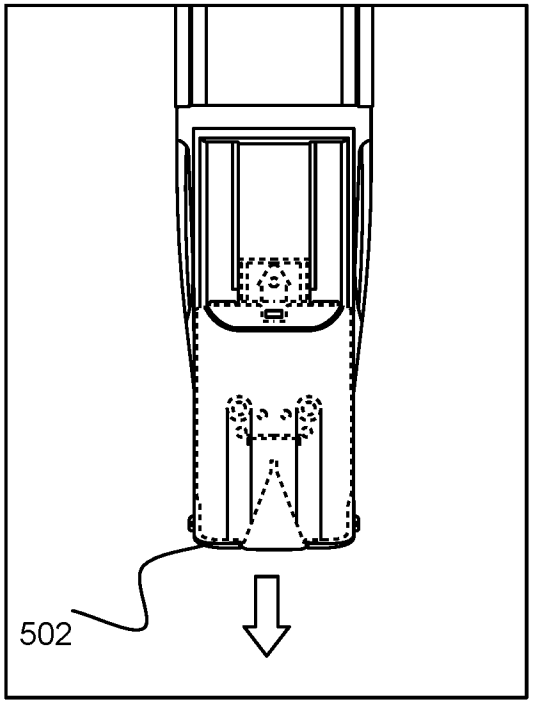

Movement of the retractable nozzle 120 from the retracted configuration to the deployed configuration will now be briefly discussed with reference to FIGS. 8*a*, 8*b*, and 8*c*. FIGS. 8*a*, 8*b* and 8*c* respectively show a partial plan view of the vacuum cleaner 100 and the retractable nozzle 120 in different positions.

The user pulls the lip 502 away from the housing 102 in a direction parallel with the longitudinal axis A-A as shown in FIG. 8*a*. The nozzle carriage 208 then slides with respect to the housing 102 and brings the first and second nozzle arms 400, 402 outside the housing 102 as shown in FIG. 8*b*. The nozzle carriage 208 is fully extended as shown in FIG. 8*b*. The first and second nozzle arms 400, 402 are then free to pivot laterally such that the first and second nozzle arms 400, 402 are aligned along an axis C-C across the longitudinal axis A-A. The user then rotates the first and second nozzle arms 400, 402 into the deployed configuration as shown in FIG. 8*c*.

Turning back to FIG. 6, the retractable nozzle 120 in the deployed configuration will be discussed in more detail. In the deployed configuration the first and second nozzle arms 400, 402 define an open nozzle channel 600 which extends along axis C-C. Axis C-C is substantially perpendicular to the longitudinal axis A-A of the vacuum cleaner 100. A first end 602, and a second end 604 of the open nozzle channel 600 are open. This means that dirt and debris can also be sucked into the vacuum cleaner 100 via the first end 602, or the second end 604 of the open nozzle channel 600. As shown in FIG. 7, the first and second nozzle arms 400, 402 are folded out laterally in the deployed position. The retractable nozzle 120 comprises a wider configuration which allows for a larger dirty air inlet 114.

In some examples, the nozzle carriage 208 optionally comprises a catch 608 for engaging a reciprocal recess mounted on the inside of the housing 102. When the nozzle carriage 208 is in the deployed configuration, the catch 608 engages with the recess and the retractable nozzle 120 is held in the deployed configuration. The friction between the catch 608 and the reciprocal recess is sufficient to prevent retraction of the retractable nozzle 120 if the user engages the retractable nozzle 120 with a surface to be cleaned. In some examples, the catch 608 comprises a catch surface 610 projecting perpendicularly from the surface of the nozzle carriage. The catch surface 610 engages with a reciprocal perpendicular surface in the reciprocal recess. When the catch surface 610 engages the reciprocal surface, the retractable nozzle 120 is prevented from moving from the deployed configuration. Accordingly, the catch 608 and the surrounding portion of the nozzle carriage 208 may need to be depressed to release the catch 608 from the reciprocal recess.

Alternatively in some examples, there is no catch 608. As mentioned above, there is a friction fit between the retractable nozzle 120 and the dirt container 118 holding the retractable nozzle 120 in place with respect to the dirt container 118 when in the deployed configuration.

In some examples, the first and second nozzle arms 400, 402 comprise an arm stop element 416 (as shown in FIG. 4). The arm stop element 416 is arranged to abut a carriage stop element 418 on the nozzle carriage 208 when the first and second nozzle arms 400, 402 are in the deployed configuration. Although only one arm stop element 416 and carriage stop element 418 is shown in FIG. 4, both the first and second nozzle arms 400, 402 comprise the arm stop element 416 and the carriage stop element 418. The arm stop element 416 and the carriage stop element 418 ensure that the first and second nozzle arms 400, 402 rotate to the correct position.

In some examples the first and second nozzle arms 400, 402 are arranged to pivot 90 degrees such that the first and second nozzle arms 400, 402 are orientated in perpendicular directions in the retracted configuration and the deployed configuration.

Optionally, the first and second nozzle arms 400, 402 comprise a first engagement finger 612 and a second engagement finger 614. The first and second engagement fingers 612, 614 respectively project from first and second arms 400, 402. The first and second engagement fingers abut each other and exert as force against each other when rotated into in the deployed configuration. This means that the first and second engagement fingers 612, 614 push against each other and hold the first and second nozzle arms 400, 402 in the deployed configuration. As the first and second engagement fingers 612, 614 are engaged, the first and second engagement fingers 612, 614 may click to together giving the user an audible and/or tactile feedback that the first and second nozzle arms 400, 402 are positioned in the deployed configuration.

In alternative examples, the first and second nozzle arms 400, 402 are pivotally mounted with sufficient friction in the pivots 404, 406 to keep the first and second nozzle arms 400, 402 in position with respect to the nozzle carriage 208.

The first and second nozzle arms 400, 402 in some alternative examples are pivotally mounted to the nozzle carriage 208 via a pivot pin (not shown) which extends through the nozzle carriage 208.

In some alternative examples, the first and second nozzle arms 400, 402 are not pivotally mounted on the nozzle carriage 208. Instead the first and second nozzle arms 400, 402 are slidably mounted in curved tracks (not shown). In this way the first and second nozzle arms 400, 402 slide from the retracted configuration to the deployed configuration. As the first and second nozzle arms 400, 402 slide in the curved tracks, the first and second nozzle arms 400, 402 move from being aligned in a direction parallel with the longitudinal axis A-A to a direction perpendicular to the longitudinal axis A-A.

In another example, two or more examples are combined. Features of one example can be combined with features of other examples.

Examples of the present disclosure have been discussed with particular reference to the examples illustrated. However it will be appreciated that variations and modifications may be made to the examples described within the scope of the disclosure.

What is claimed is:

1. A vacuum cleaner comprising:

a housing having a longitudinal axis;

a motor-fan assembly mounted in the housing arranged to generate an airflow along an airflow path from a dirty air inlet to an air exhaust; and a retractable nozzle defining the dirty air inlet and moveably mounted on the housing and at least a portion of the retractable nozzle is arranged to move between a retracted configuration within the housing and a deployed configuration outside the housing;

wherein the retractable nozzle includes at least two nozzle arms, each nozzle arm having a longitudinal axis so that in the retracted configuration the at least two nozzle arm longitudinal axes are parallel to the longitudinal axis of the housing and the at least two nozzle arm longitudinal axes in the deployed configuration are perpendicular to the longitudinal axis of the housing; and wherein the retractable nozzle is arranged to slide with respect to the housing when moving in a direction along the longitudinal axis of the housing.

2. The vacuum cleaner according to claim 1 wherein the housing comprises a dirt container and the at least two nozzle arms are arranged to be positioned within the dirt container when the retractable nozzle is in the retracted configuration.

3. The vacuum cleaner according to claim 2 wherein the dirt container is translucent.

4. The vacuum cleaner according to claim 2 wherein the dirt container and retractable nozzle are detachable from the housing.

5. The vacuum cleaner according to claim 1 wherein the at least two nozzle arms are arranged to pivot in a direction across the longitudinal axis of the housing.

6. The vacuum cleaner according to claim 5 wherein the retractable nozzle comprises a slidable nozzle carriage and at least one nozzle arm is pivotally mounted on the slidable nozzle carriage.

7. The vacuum cleaner according to claim 1 wherein the housing comprises at least one guide track arranged to receive a portion of the retractable nozzle such that the at least one guide track limits the movement of the retractable nozzle with respect to the housing.

8. The vacuum cleaner according to claim 1 wherein a cross-sectional area of the dirty air inlet is larger when the retractable nozzle is in the deployed configuration than when the retractable nozzle is in the retracted configuration.

9. The vacuum cleaner according to claim 1 wherein one or more accessories are attachable to the retractable nozzle when the retractable nozzle is in the retracted configuration.

10. The vacuum cleaner according to claim 1 wherein the retractable nozzle comprises at least one catch for selectively securing the retractable nozzle in the deployed configuration or the retracted configuration.

11. The vacuum cleaner according to claim 1 wherein the retractable nozzle defines an open channel in a direction across the longitudinal axis of the housing when the retractable nozzle is in the deployed configuration.

12. The vacuum cleaner according to claim 1 wherein the retractable nozzle comprises a projecting lip grippable by a user such that the user can manually move the retractable nozzle from the retracted configuration to the deployed configuration.

13. The vacuum cleaner according to claim 1 wherein the vacuum cleaner is a handheld vacuum cleaner.

14. A vacuum cleaner comprising:

a housing having a longitudinal axis;

a motor-fan assembly mounted in the housing arranged to generate an airflow along an airflow path from a dirty air inlet to an air exhaust; and a retractable nozzle defining the dirty air inlet and moveably mounted on the housing and at least a portion of the retractable nozzle is arranged to move between a refracted configuration within the housing and a deployed configuration outside the housing;

wherein the retractable nozzle includes at least two nozzle arms, each nozzle arm having a longitudinal axis so that in the refracted configuration the at least two nozzle arm longitudinal axes are parallel to the longitudinal axis of the housing and the at least two nozzle arm longitudinal axes in the deployed configuration are perpendicular to the longitudinal axis of the housing;

wherein the at least two nozzle arms are arranged to pivot in a direction across the longitudinal axis of the housing;

wherein the retractable nozzle comprises a slidable nozzle carriage and at least one nozzle arm is pivotally mounted on the slidable nozzle carriage; and wherein the at least two nozzle arms comprises a first nozzle arm and a second nozzle arm pivotally mounted on the slidable nozzle carriage.

15. A vacuum cleaner comprising:

a housing having a longitudinal axis;

a motor-fan assembly mounted in the housing arranged to generate an airflow along an airflow path from a dirty air inlet to an air exhaust; and a retractable nozzle defining the dirty air inlet and moveably mounted on the housing and at least a portion of the retractable nozzle is arranged to move between a retracted configuration within the housing and a deployed configuration outside the housing;

wherein the portion of the retractable nozzle in the retracted configuration is aligned in a direction along the longitudinal axis and the portion of the retractable nozzle in the deployed configuration is aligned in a direction across the longitudinal axis wherein the housing comprises at least one guide track arranged to receive the portion of the retractable nozzle such that the at least one guide track limits the movement of the retractable nozzle with respect to the housing; and wherein the retractable nozzle comprises a pivot and the pivot is arranged to slide within the at least one guide track.

16. A vacuum cleaner comprising:

a housing having a longitudinal axis;

a motor-fan assembly mounted in the housing arranged to generate an airflow along an airflow path from a dirty air inlet to an air exhaust; and a retractable nozzle defining the dirty air inlet and moveably mounted on the housing and at least a portion of the retractable nozzle is arranged to move between a refracted configuration within the housing and a deployed configuration outside the housing;

wherein the retractable nozzle includes at least two nozzle arms, each nozzle arm having a longitudinal axis so that in the refracted configuration the at least two nozzle arm longitudinal axes are parallel to the longitudinal axis of the housing and the at least two nozzle arm longitudinal axes in the deployed configuration are perpendicular to the longitudinal axis of the housing; and wherein the retractable nozzle is configured to move along the airflow path when the retractable nozzle moves within the housing.

* * * * *